US005463819A

United States Patent [19]

Komori

[11] Patent Number: 5,463,819

[45] Date of Patent: Nov. 7, 1995

[54] DEHYDRATION TREATMENT APPARATUS FOR SLUDGE

[76] Inventor: Yasumasa Komori, 5-17-19, Nagao, Tama-ku, Kawasaki-shi, Kanagawa, Japan

[21] Appl. No.: 234,732

[22] Filed: Apr. 28, 1994

[30] Foreign Application Priority Data

Mar. 4, 1994 [JP] Japan ..... 6-060255

[51] Int. Cl.[6] ..... F26B 11/02

[52] U.S. Cl. ..... 34/135; 34/130; 110/226; 432/117; 432/118; 210/609

[58] Field of Search ..... 110/226; 210/770, 210/771, 609; 34/135, 136, 137, 130, 318, 389; 432/117, 118

[56] References Cited

U.S. PATENT DOCUMENTS

| | | | |
|---|---|---|---|
| 2,043,459 | 6/1936 | Windecker | 110/226 |
| 2,213,667 | 9/1940 | Dundas et al. | 110/226 |
| 4,071,962 | 2/1978 | Saeman | 34/447 |
| 4,977,839 | 12/1990 | Fochtman et al. | 110/226 |
| 5,283,961 | 2/1994 | Gobel | 110/226 |

*Primary Examiner*—Denise L. Gromada
*Attorney, Agent, or Firm*—Jordan and Hamburg

[57] ABSTRACT

A dehydration treatment apparatus for sludge wherein organic sludge and a modifying/setting agent are charged into a rotating drum and the sludge is dehydrated and dried. The apparatus comprises a rotating drum, a sludge charging hopper arranged on the inlet side of said rotating drum, a discharging screw arranged on the outlet side of the rotating drum, at least two rectangular blades that are projected from each of circular surfaces arranged toward the feeding direction from the inlet side of the inner circumferential surface of the rotating drum and are slanted downward at a prescribed angle toward the feeding direction, and an agitating/feeding means wherein the positions of the blades on the circular surfaces are made different stepwise successively in the direction of rotation toward the feeding direction so that sludge may be scraped up by the blades on the fore circular surface to be fed forward.

11 Claims, 5 Drawing Sheets

DEHYDRATION TREATMENT APPARATUS FOR SLUDGE

FIELD OF THE INVENTION

The present invention relates to a dehydration treatment apparatus for sludge wherein organic sludge and a modifying/setting agent are charged into a rotating drum and the sludge is dehydrated and dried.

DESCRIPTION OF THE PRIOR ART

Hitherto, as a dehydration treatment apparatus for sludge, there is a dehydration treatment apparatus for sludge wherein a screw is provided in a rotating drum. Such a dehydration treatment apparatus is attended with a problem that sludge clings to the screw to make the feeding insufficient and therefore the agitation cannot be carried out throughout the inside of the rotating drum uniformly.

There is also an apparatus wherein a helical agitating blade is projected from the inner circumferential surface of a rotating drumby which sludge flowed into the rotating drum is agitated and is fed forward. In this apparatus, since the blade is relatively long, the sludge scraped up by the blade easily adheres to the blade and does not drop satisfactorily. Therefore, there is a problem that the agitating/feeding becomes unsatisfactory.

SUMMARY OF THE INVENTION

An object of the present invention is to provide a dehydration treatment apparatus that solves the above problems, makes sludge less adhere and less remain on agitating blades, and can agitate the whole of sludge positively.

According to the present invention, the dehydration treatment apparatus for sludge comprises a rotating drum, a sludge charging hopper and a modifying/setting agent charging hopper that are arranged on the inlet side of said rotating drum, a discharging screw arranged on the outlet side, rectangular blades that are projected from circular surfaces arranged from the inlet side of the inner circumferential surface of the rotating drum toward the feeding direction and are inclined downward at a prescribed angle toward the feeding direction, and an agitating/feeding means wherein the positions of the rectangular blades on the circular surfaces are made different stepwise in the direction of rotation successively toward the feeding direction so that the blades on the fore circular surface may scrape up the sludge and then drop the sludge onto the next circular surface to feed the sludge, then the blades on said next circular surface may scrape up the sludge to agitate further the sludge, and the blades on the successive circular surfaces arranged in the feeding direction may scrape up the sludge and may feed the sludge forward successively.

Owing to this constitution, since the sludge flowed into the rotating drum is scraped up and is agitated in the flow of the sludge by the blades without being forced and the sludge on the blades is pushed to be dropped forward by the flow of the sludge, there is such an effect that the whole sludge is positively agitated and is fed forward without the sludge remaining adhered on the blades and the sludge that is slushy at the time of the introduction can be made dry when it is discharged.

DESCRIPTION OF THE PREFERRED EMBODIMENT

Figure 1:
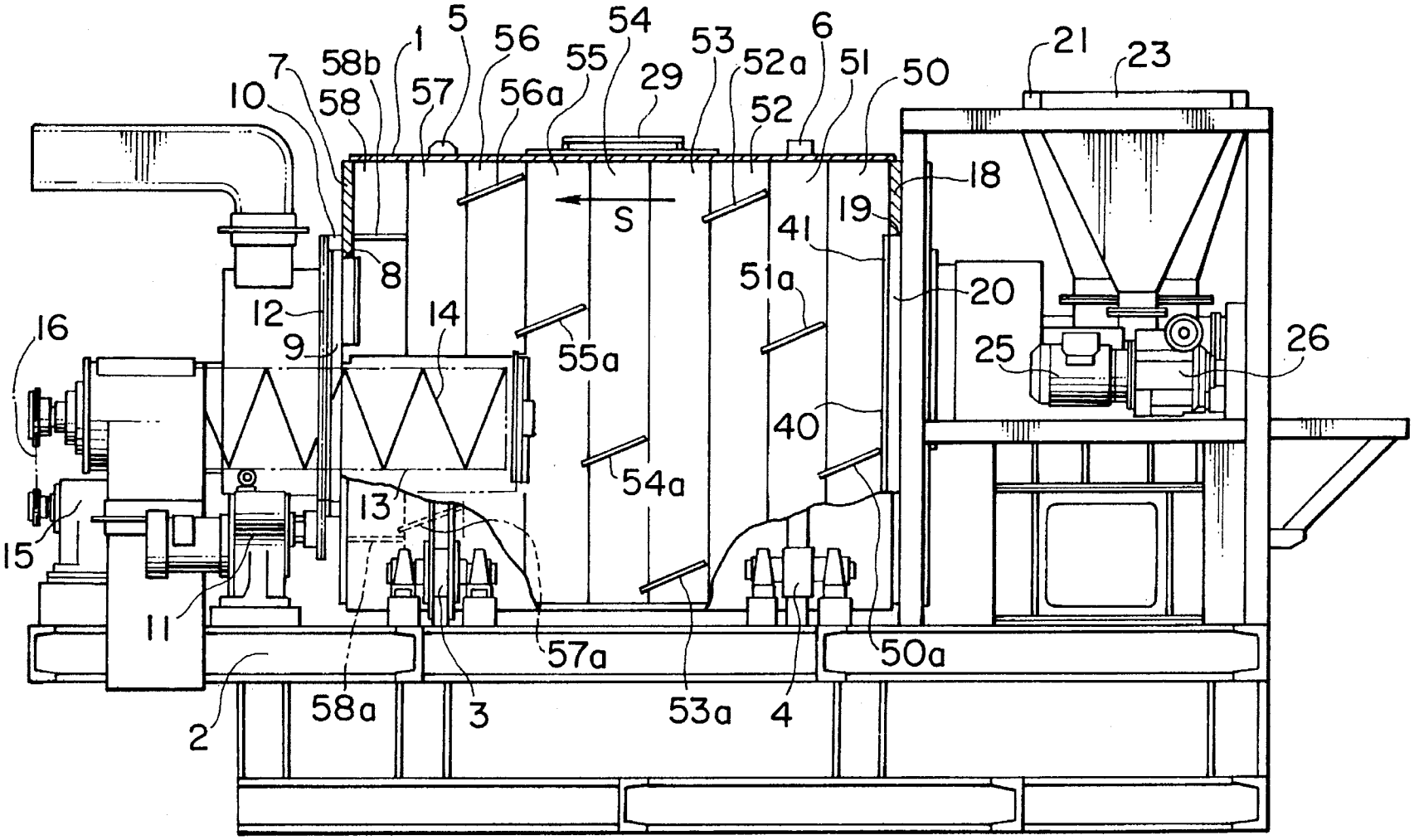
FIG. 1 is a front view of the whole of the present apparatus with the rotating drum in section.
Figure 2:
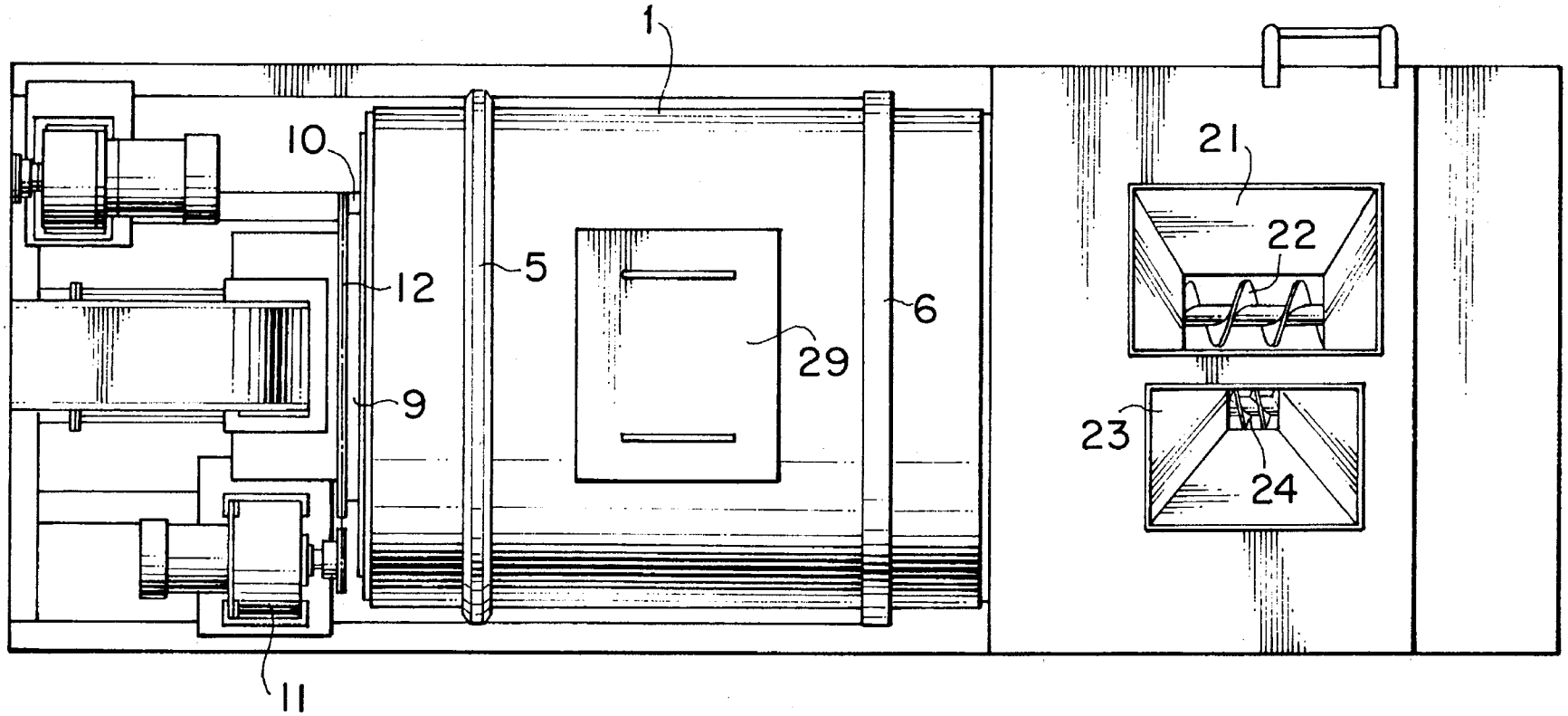
FIG. 2 is a plan view of FIG. 1.
Figure 3:
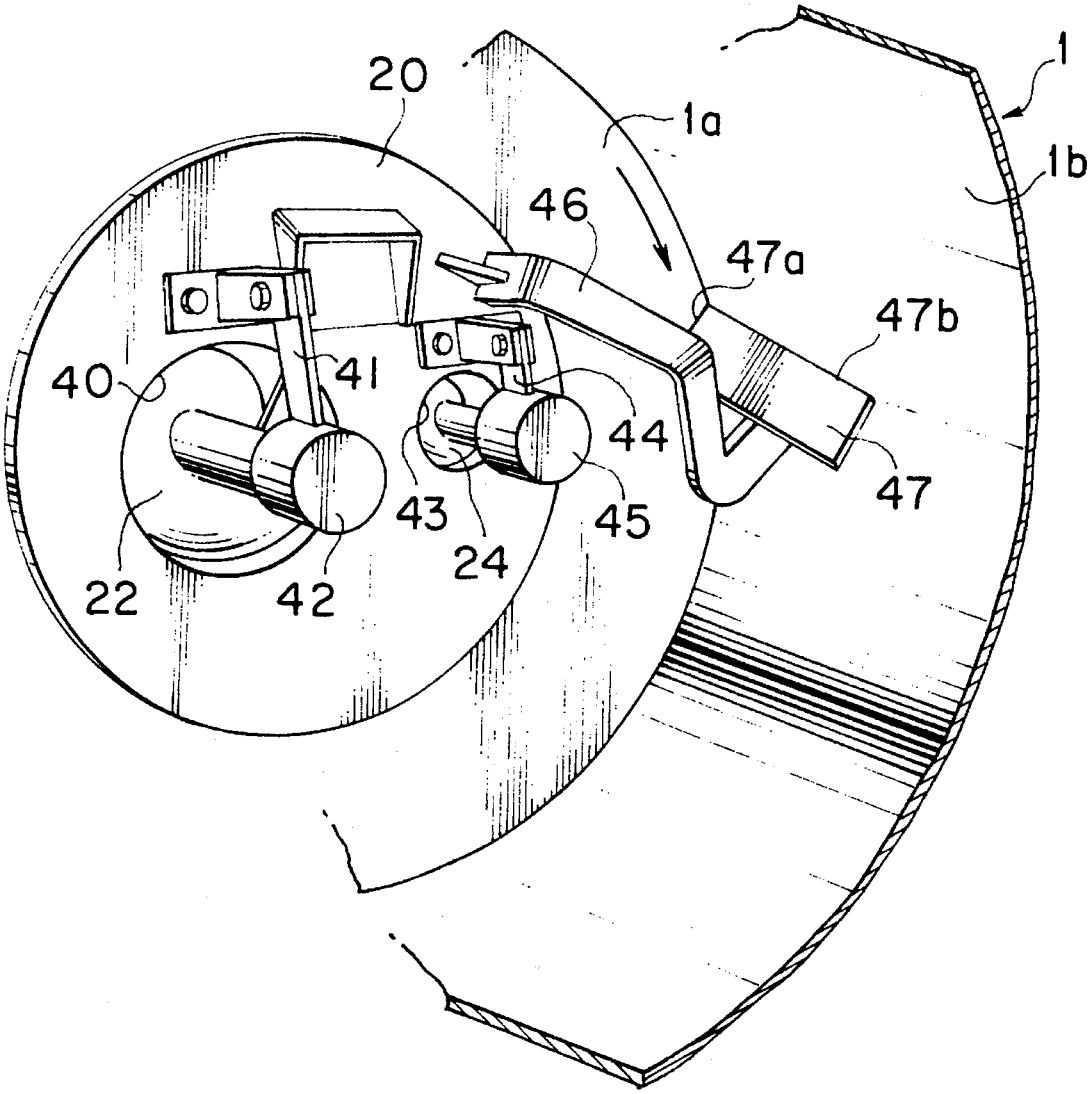
FIG. 3 is a perspective view of the inner end surface, inner circumferential surface, and scraping plate part of the rotating drum of FIG. 1.
Figure 4:
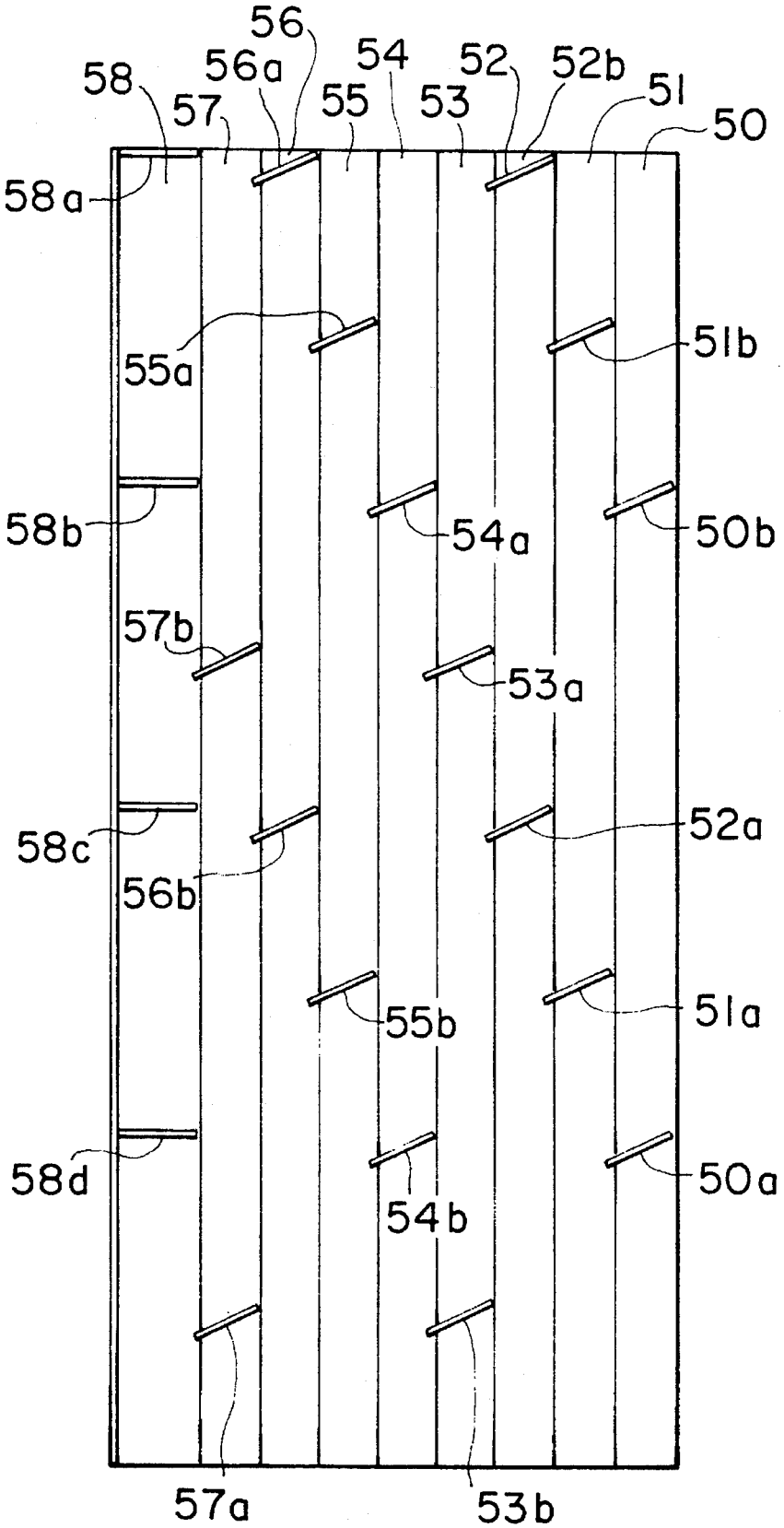
FIG. 4 is a development of the rotating drum of FIG. 1.

An embodiment of the present invention is now be described with reference to the drawings. Rings 5, 6 of a rotating drum 1 are placed on front and rear wheels 3, 4 arranged on a base 2. A circular hole 8 is formed in a front plate 7 of the rotating drum 1 concentrically with the rotating drum shaft and an outlet fixed plate 9 is abutted against the circular hole 8 to seal it. A pulley 10 integral with the front plate 7 is driven with a belt 12 by a motor 11 placed on the base 9. A cylindrical holding part 13 is extended through the outlet fixed plate 9 from the inside of the rotating drum 1 to the outside thereof. A discharging screw 14 is provided for the cylindrical holding part 13 and is driven with a belt 16 by a reversible motor 15 placed on the base 2. A rear plate 18 of the rotating drum 1 is formed with a circular hole 19 concentric with the rotating drum shaft and an inlet fixed plate 20 is abutted against the circular hole 19 to seal it. 21 indicates a sludge charging hopper. The shaft forward end of a sludge charging screw 22 situated in the lower part of the sludge hopper 21 is projected from an opening 40 of the inlet fixed plate 20 and is supported by a bearing 42 at the forward end of an arm 41 fixed to the inlet fixed plate 20. 23 indicates a modifying/setting agent charging hopper. The shaft forward end of a modifying/setting agent charging screw 24 situated in the lower part of the modifying/setting agent charging hopper 23 is projected from the opening 40 of the inlet fixed plate 20 and is supported by a bearing 45 of the forward end of an arm 44 fixed to the inlet fixed plate 20. The sludge charging screw 22 and the modifying/setting agent charging screw 24 are driven by motors 25, 26 placed on the base 2. 29 indicates a lid of the rotating drum 1. The base of a scraping plate arm 46 is fixed to the inlet fixed plate 20 and the scraping plate arm 46 is arranged downward obliquely. A quadrangular scraping plate 47 having sides **47*a*, 47*b* that abut against an inlet side inner end surface peripheral part 1*a* and an inlet side inner circumferential surface corner peripheral part 1*b* of the rotating drum 1 on the right of the arrow is fixed to the forward end of the scraping plate arm 46**.

Figure 5:
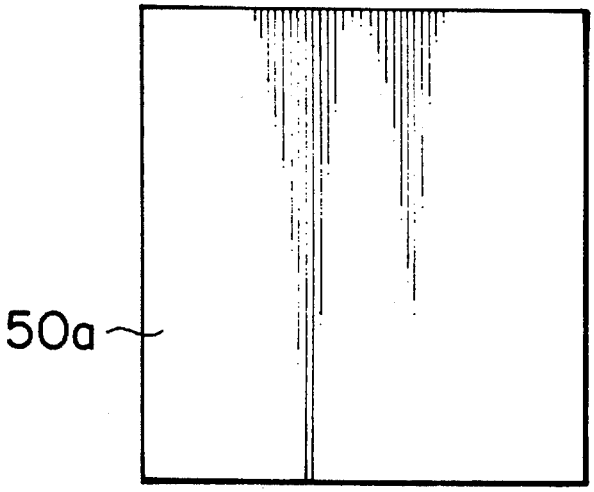
FIG. 5 is a front view of the blade.
Figure 6:
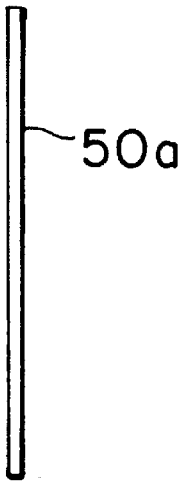
FIG. 6 is a side view of the blade.

Two blades **50*a*, 50*b* are projected from an inlet side circular surface 50 of the inner circumferential surface of the rotating drum 1 with the blades 50*a*, 50*b* spaced 180° from each other. As shown in FIGS. 5 and 6, each of the blades 50*a*, 50*b* is rectangular in shape and has a width of 220 mm and a height of 240 mm (that is, the width is larger than the height), and is inclined downward at an angle of 25° toward the feeding direction S. Two blades 51*a*, 51*b* having the same shape as that of the above blades are projected from a next circular surface 51 adjacent to the circular surface 50 with the blades 51*a*, 51*b* at an angle 45° to the blades 50*a*, 50*b* in the direction of rotation. The first blades 50*a*, 50*b* overlap the second blades 51*a*, 51*b* by about 30 mm. In this way, blades, 52*a* and 52*b*, 53*a* and 53*b*, 54*a* and 54*b*, 55*a* and 55*b*, 56*a* and 56*b*, and 57*a* and 57*b* are projected from circular surfaces 52, 53, 54, 55, 56, and 57** respectively, which are mentioned successively in the feeding direction.

As a result, the adjacent blades **50*a*, 51*a*, 52*a*, 53*a*, 54*a*, 55*a*, 56*a*, and 57*a* and the adjacent blades 50*b*, 51*b*, 52*b***, 53*b*, 54*b*, 55*b*, 56*b*, and 57*b* on the adjacent circular surfaces are arranged obliquely toward the feeding direction. Four discharging blades 58*a*, 58*b*, 58*c*, and 58*d* are projected from the last circular surface 58 and are in parallel with the feeding direction S.

The operation of the thus constituted dehydration treatment apparatus for sludge is now described below.

The sludge charged from the sludge charging hopper 21 is charged continuously into the rotating drum 1 through the opening 40 in the inlet fixed plate 20 by the sludge charging screw 22 rotated by the motor 25. Further, a modifying/setting agent of a cement type or a lime type charged from the modifying/setting agent charging hopper 23 is charged continuously into the rotating drum 1 through the opening 40 of the inlet fixed plate 20 by the modifying/setting agent charging screw 24 rotated by the motor 26.

Further, air is also fed from an apparatus (not shown). The rotating drum 1 is rotated clockwise as shown by the arrow. When the sludge and the modifying/setting agent dropped into the rotating drum 1 meet first together, heat is generated, then they became a state wherein they are most liable to adhere, and they adhere to the inlet side inner end surface peripheral part 1*a* and the inlet side inner end surface peripheral part 1*b*. The adhered sludge is then scraped up by the sides 47*a*, 47*b* of the scraping plate 47 and is dropped into the rotating drum 1. Thus, the sludge and the modifying/setting agent are not accumulated on the inlet inner end surface and the inner circumferential surface corner of the rotating drum 1.

The rotating drum 1 is rotated at 5 to 10 r.p.m. by the motor 11. The sludge fed to the inlet side circular surface 50 of the rotating drum 1 is scraped up by the first blades 50*a*, 50*b*. Since the blades 50*a*, 50*b* are inclined downward toward the feeding direction S, the sludge is rotated upward and is dropped on the next circular surface 51. Then the sludge is scraped up by the blades 51*a*, 51*b* projected from that circular surface 51, is then rotated and is dropped on the next circular surface 52 in the same way as described above. In this manner, the sludge is successively scraped up and dropped on the circular surfaces that are successive in the feeding direction, so that the sludge is agitated and fed.

During that period, since the blades scrape up the sludge, not forcibly in the sludge flowed into the rotating drum 1, with the sludge pushed by the flow of the sludge and the sludge is pushed forward, the sludge on the blades adheres less and drops forward positively. Accordingly the sludge is agitated well and the sludge that is slushy at the time of the introduction becomes dry when it is discharged.

Further, the angle of the slant of the blades, the number of the blades, etc. can be changed in conformity with the property of the sludge.

What is claimed is:

1. A dehydration treatment apparatus for sludge comprising a rotating drum having an axis, said drum having an inside circumferential surface, said drum having one longitudinal end provided with sludge inlet means and the other longitudinal end provided with sludge outlet means, first blades disposed on the inside circumferential surface of said drum, said first blades being disposed at an acute angle relative to said axis such that upon rotation of said drum, said first blades engage said sludge to provide a component force which urges said sludge longitudinally toward said outlet means, second blades disposed on the inside circumferential surface of said drum, said second blades being disposed at an acute angle relative to said axis such that upon rotation of said drum, said second blades engage said sludge to provide a component force which urges said sludge longitudinally toward said outlet means, said second blades being upstream of said first blades, said drum having an end wall perpendicular to said axis, said end wall having a central opening, a fixed plate means disposed over said central opening, said fixed plate means being perpendicular to said axis, said fixed plate means mounting a fixed scraping plate having one scraping surface which scrapes said end wall and another scraping surface which scrapes the inside circumferential surface of said drum which is juxtaposed to said end wall.

2. A dehydration treatment apparatus according to claim 1 wherein said one scraping surface is disposed at right angles to said other scraping surface.

3. A dehydration treatment apparatus according to claim 1 wherein said fixed plate means has a first and a second plate opening, said inlet means comprising sludge charging means for charging sludge into the inside of said drum through said first plate opening, said inlet means further comprising modifying/setting agent charging means for charging a modifying/setting agent into the inside of said drum through said second plate opening.

4. A dehydration treatment apparatus according to claim 1 further comprising mounting means in said drum mounting said scraping plate on said fixed plate means.

5. A dehydration treatment apparatus according to claim 1 wherein said inlet means comprises screw conveyor means, said screw conveyor means having an inner end extending into said drum, a mounting bracket within said drum fixed to said fixed plate means, said mounting bracket supporting said inner end of said screw conveyor means.

6. A dehydration treatment apparatus according to claim 5 wherein said drum has an outlet end wall, said outlet end wall having an opening, said outlet means comprising a discharge screw conveyor passing through said opening and extending into said drum.

7. A dehydration treatment apparatus according to claim 1 wherein said first and second blades are each disposed at about a 45 degree angle relative to said axis.

8. A dehydration treatment apparatus according to claim 1 wherein said second blades are circumferentially offset about 45 degrees from said first set of blades.

9. A dehydration treatment apparatus according to claim 1 wherein said first blades comprise two blade elements spaced 180 degrees apart.

10. A dehydration treatment apparatus according to claim 1 wherein said first blades longitudinally overlap with said second blades and wherein said first blades are circumferentially spaced from said second blades.

11. A dehydration treatment apparatus for sludge comprising a rotating drum having an axis, said drum having an inside circumferential surface, said drum having one longitudinal end provided with sludge inlet means and the other longitudinal end provided with sludge outlet means, first blades disposed on the inside circumferential surface of said drum, said first blades being disposed at an acute angle relative to said axis such that upon rotation of said drum, said first blades engage said sludge to provide a component force which urges said sludge longitudinally toward said outlet means, second blades disposed on the inside circumferential surface of said drum, said second blades being disposed at an acute angle relative to said axis such that upon rotation of said drum, said second blades engage said sludge to provide a component force which urges said sludge longitudinally toward said outlet means, said second blades being upstream of said first blades, said drum having an end wall perpendicular to said axis, said end wall having a central opening, a fixed plate means disposed over said central opening, said fixed plate means being perpendicular to said axis, said fixed plate means mounting a fixed scraping plate having one scraping surface disposed at right angles to a second scraping surface, said one scraping surface being disposed to scrape said end wall and said second scraping surface being disposed to scrape the inside circumferential surface of said drum which is juxtaposed to said end wall.

* * * * *